US005419369A

United States Patent [19]

House et al.

[11] Patent Number: 5,419,369

[45] Date of Patent: May 30, 1995

[54] SOLENOID OPERATED PRESSURE CONTROL VALVE

[75] Inventors: William J. House, Sterling Heights; Keith D. Marsh, St. Clair Shores; Jerry A. Sowik, Livonia, all of Mich.

[73] Assignee: Coltec Industries Inc., New York, N.Y.

[21] Appl. No.: 202,575

[22] Filed: Feb. 28, 1994

[51] Int. Cl.[6] ..... F15B 13/044

[52] U.S. Cl. ..... 137/625.65; 251/129.21

[58] Field of Search ..... 137/625.65; 251/129.21

[56] References Cited

U.S. PATENT DOCUMENTS 4,917,150 4/1990 Koch et al. ..... 137/625.65

*Primary Examiner*—Gerald A. Michalsky

*Attorney, Agent, or Firm*—Howard S. Ritter

[57] ABSTRACT

A solenoid actuated valve for regulating the fluid pressure at a control port by cyclically connecting the control port alternately to a fluid pressure supply source and to a sump includes a sleeve-like valve member slidably mounted on a fixed valve member for movement between two positions in response to energization or deenergization of the solenoid coil. The valve sleeve is the armature of the solenoid and operates within an internal chamber in the valve housing with pressure within the chamber being at least substantially balanced against its opposite ends. Energization and deenergization of the solenoid coil may be controlled by an electronic processor which supplies a pulse width modulated electric control signal variable in response to processor inputs to establish a control port pressure which is accurately linearly related to the time duration of the pulse width modulated signal.

5 Claims, 4 Drawing Sheets

SOLENOID OPERATED PRESSURE CONTROL VALVE

FIELD OF THE INVENTION

The present invention relates to solenoid operated pressure control valves employed in applications where the valve will accurately vary the pressure at a control port in accordance with variations in an electrical control signal, which may be derived from a computer, which varies the on-off time of energization of the solenoid.

BACKGROUND OF THE INVENTION

While there are many applications for such a valve, one application which has been of interest in recent years is that of the control of an automatic transmission for a motor vehicle by independently regulating the engagement pressure applied to each of the various clutches in the transmission. The torque transmitted by a given clutch may be varied by varying the pressure of engagement between the opposed clutch plates. Presently available electronic control units can rapidly and precisely generate the desired electrical output signals in response to sensed vehicle operating conditions. However, converting these electrical control signals into a precisely proportional fluid pressure which will accurately track variations in the electrical control signal has posed problems.

In such a system, a solenoid actuated valve is a logical choice as the interface between the electrical and hydraulic portions of the system. See, for example, U.S. Pat. No. 4,579,145 which describes a solenoid actuated valve for such an application. A system employing a valve of the type shown in that patent is described in some detail in SAE Technical Paper 840448.

As in U.S. Pat. No. 4,579,145 the solenoid actuated valve may be designed to regulate the pressure at a control port by cyclically connecting the control port alternately to a source of fluid under pressure and to a fluid sump, these alternate connections being made in accordance with the energization or deenergization of the solenoid coil. An electronic processor may be employed to regulate the time during each cycle the coil is energized ("on time"), the coil being deenergized for the remainder of the cycle ("off time"), this type of regulation being commonly referred to as pulse width modulation. A typical operating frequency might be 60 Hz. In steady state operation the pressure at the control port will be that percentage of the fluid source pressure which is equal to that percentage of time which the control port is connected to the fluid source, sump pressure being assumed to be zero.

In order to enable the control port pressure to be varied in a true linear relationship to variations in "on time" of the solenoid coil, the valve member which controls the fluid connection of the control port to pressure supply or sump must be capable of rapid shifting movement in close synchronism with the energization and deenergization of the coil. Further, the valve member should also be movable in response to a relatively small magnetic force in order to minimize the size and power requirements of the solenoid.

The present invention is especially directed to a solenoid valve having these last characteristics.

SUMMARY OF THE INVENTION

In accordance with the present invention, an elongate valve sleeve is slidably and sealingly mounted upon the exterior of an elongate fixed valve member. The opposite ends of the fixed valve member project beyond the opposite ends of the valve sleeve and are sealingly received within a housing at opposed ends of an internal chamber within the housing. The valve sleeve is axially slidable on the fixed valve member. A solenoid coil is mounted in the housing and generally surrounds one axial end of the valve sleeve. A pole piece is situated as to be axially spaced by an air gap from an axial end of the valve sleeve. The air gap exists when the solenoid coil is not energized. A first fluid flow path is created by the fixed valve member and the valve sleeve when the solenoid coil is not energized and a second fluid flow path is created by the fixed valve member and the valve sleeve when the solenoid coil is energized.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity details and/or elements may be omitted from one or more views.

DETAILED DESCRIPTION OF THE PREFERRED EMBODIMENT

Figure 1:
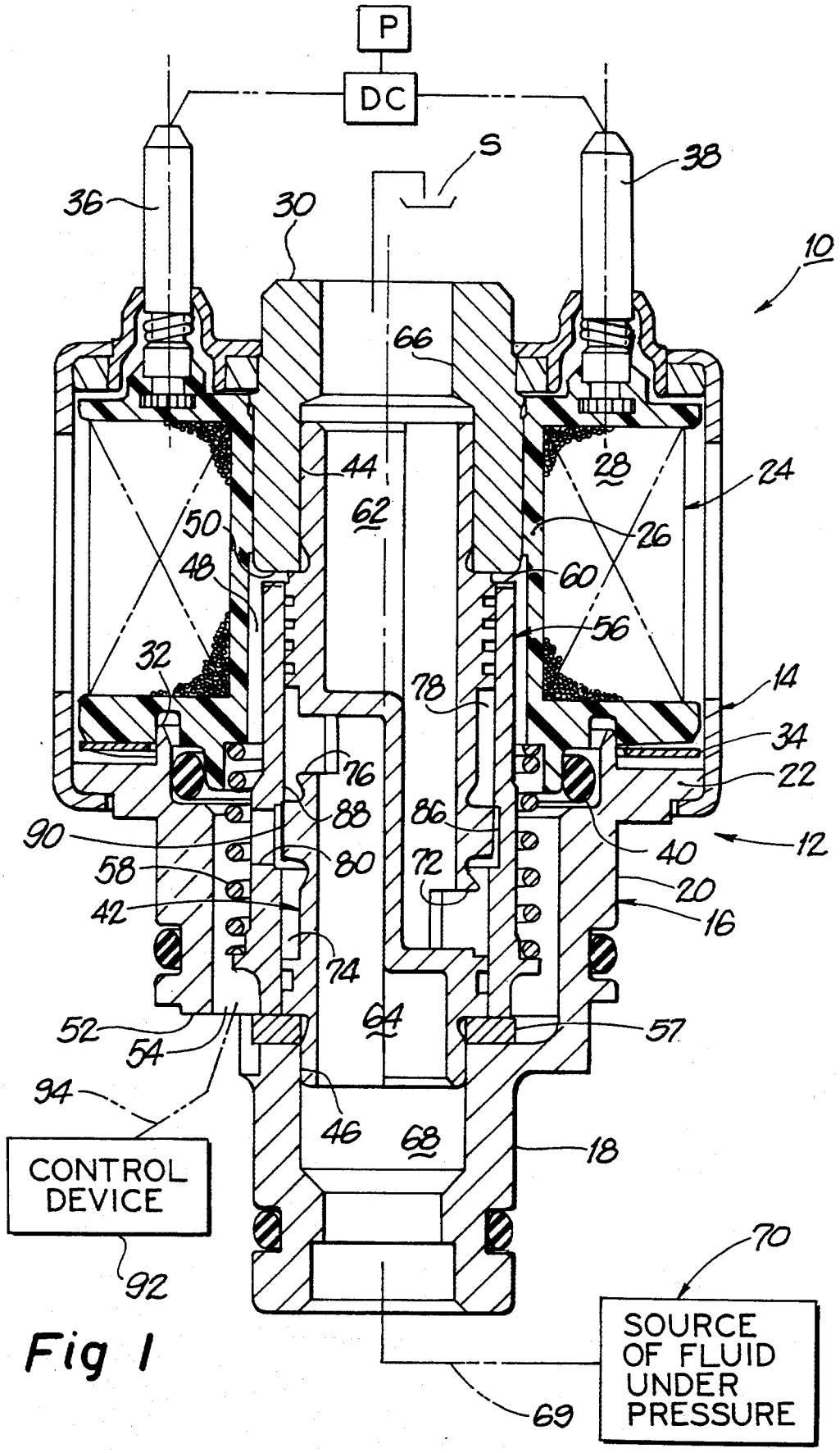
FIG. 1 is a generally axial cross-sectional view of a pressure regulating device employing teachings of the invention.

Referring first to FIG. 1, a solenoid operated valve assembly 10 is illustrated as comprising a multi-part housing 12 which, in turn, is shown as comprising housing portions or sections 14 and 16. Housing section 16 has a comparatively reduced diameter lower end portion 18, a somewhat larger diameter intermediate portion 20 and a radially outwardly projecting flange 22.

A solenoid coil assembly designated generally 24 including an annular frame or bobbin 26, an annular solenoid coil 28 and a pole piece 30 is mounted, generally, atop lower (as viewed in FIG. 1) housing section 16 and located in coaxial relationship with the lower housing member 16 as by a generally circular tongue-and-groove arrangement indicated at 32.

A sinuous annular spring 34, engaged between solenoid frame or bobbin 26 and the upper portion of housing section 16, biases solenoid assembly 24 upwardly into operative engagement with the generally cylindrical housing section 14.

A pair of electrical terminals or contacts 36 and 38 project upwardly as to provide for electrical connections to the windings of solenoid coil 28. An O-ring 40 provides a fluid seal between lower housing section 16 and solenoid assembly 24.

Within housing means 12, an elongate fixed valve member 42 has its upper (as viewed in FIG. 1) end closely received within a bore 44 in pole piece 30. The valve member 42 has an upper annular surface or face 43 which is in fluid sealing relationship to end face 50 ofpole piece 30. The lower end of fixed valve member 42 is received within a bore 46 in lower portion 18 of housing section 16 and is in sealed relationship with the wall of bore 46.

When the structure of FIG. 1 is fully assembled, all of the parts or elements thus far described are fixedly and sealingly operatively secured to each other. An elongate, annular internal chamber 48 is formed within such assembled parts to extend downwardly from the lower end 50 of pole piece 30 to the shoulder 52 at the lower end of intermediate housing portion 20. The chamber 48 opens to the exterior of housing 16 as through control ports one of which is depicted at 54 at the general juncture of housing sections 18 and 20.

Within chamber 48, an elongate valve sleeve 56 is slidably and sealingly mounted on the exterior of fixed valve 42. Valve sleeve 56 is constructed of a ferromagnetic material and functions not only as a valve member but also comprises the armature of solenoid coil 28. A coil spring 58 resiliently biases sleeve 56 downwardly against an annular spacer 57 located within housing 16 generally at the lower end of chamber 48. When the valve sleeve 56 is engaged with spacer 57, a relatively small air gap exists between the lower end 50 of the pole piece 30 and the upper juxtaposed end 60 of the valve sleeve 56.

Fixed valve member 42 is formed with two generally blind bores or passages 62 and 64 which to some extent actually extend past each other. The upper end of bore 62 communicates with a passage 66 formed in pole piece 30 which, in turn, leads to sump, S. The lower end of bore 64 communicates with a passage or conduit portion 68 which, via conduit means 69, communicates with a source 70 of fluid under pressure.

The lower end of bore 62 communicates with a port 72 which, in turn, is in communication with an annular space 74 which is generally between the armature 56 and fixed valve body 42. Similarly, the upper end of bore 64 communicates with a port 76 which, in turn, is in communication with an annular space 78 which is also generally between the armature 56 and fixed valve body 42.

Armature 56 is preferably provided with a plurality of passages or orifices, one of which is shown at 80, formed through the body of armature 56 which communicate between chamber 48 and an inner annular groove 86 formed into the inner cylindrical surface 88 of armature 56. A cylindrical land or valving surface 90, carried by fixed valve body 42, is in general juxtaposition to annular groove 86 and, in the valving condition depicted, partially overlaps the inner surface 88 of armature 56.

In the operating position depicted in FIG. 1, communication between annular chamber 78 and annular groove or recess 86 is prevented by the overlapping condition of armature inner surface 88 and fixed valve annular surface 90. Therefore, the relatively high pressure fluid supplied via conduit means 69 and 68 to lower bore 64, and communicated via port 76 to annular chamber 78, is prevented from communicating with the device or apparatus 92 being controlled. During such condition of operation, control device 92 communicates with sump, S, externally of assembly 10, as via conduit means 94, chamber 48, passage or aperture 80, annular groove 86, annular chamber 74, port 72, bore 62-and passage or conduit means 66. Such communication is made possible by the lower end (as viewed in FIG. 1) of cylindrical valve surface 90 not being in overlapping relationship to the armature inner surface 88. Such fluid communication will exist when solenoid coil 28 is not energized.

FIGS. 2–6 further illustrate the preferred embodiment of the fixed valve member 42.

Figure 2:
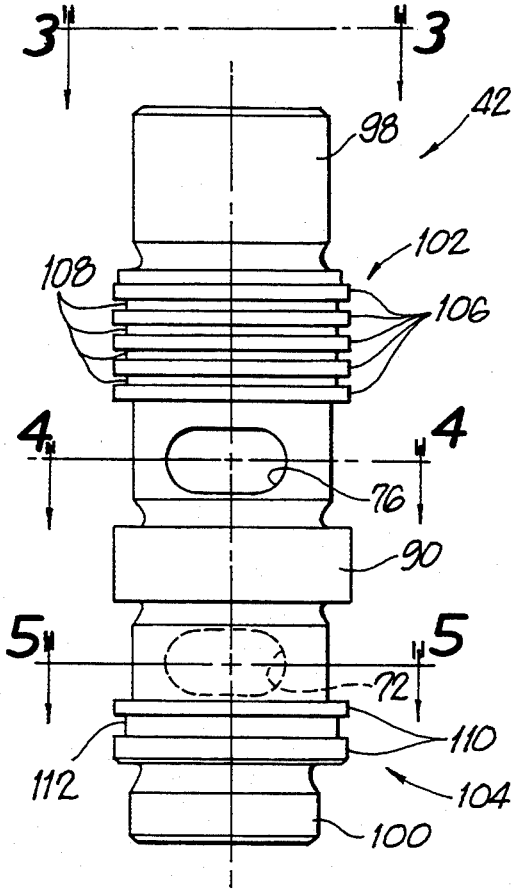
FIG. 2 is a side elevational view of one of the elements shown in FIG. 1.

As viewed in FIG. 2, the valve member 42 has upper and lower cylindrical portions 98 and 100 (respectively received in bores 44, 46 FIG. 1) and armature guiding or piloting portions 102 and 104. Pilot portion 102 is preferably comprised of a plurality of relatively narrow cylindrical surfaces 106—106 between which are respective annular grooves 108. Pilot portion 104 is similarly comprised of relatively narrow cylindrical surfaces 110—110 between which is an annular groove 112.

The diametrical dimensions of the cylindrical surfaces 106, the cylindrical surfaces 110 and the cylindrical surface 90 may be substantially the same.

Figure 3:
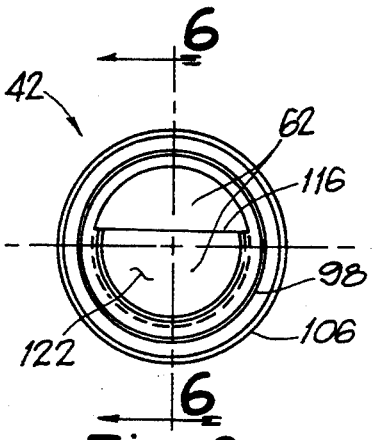
FIG. 3 is a view taken generally on the plane of line 3—3 of FIG. 2 and looking in the direction of the arrows.
Figure 4:
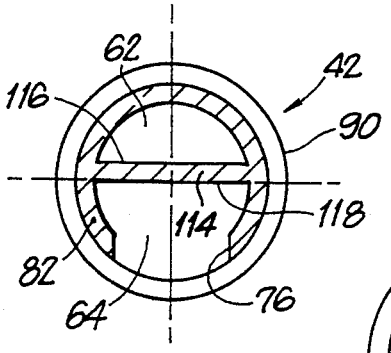
FIG. 4 is a cross-sectional view taken generally on the plane of line 4—4 of FIG. 2 and looking in the direction of the arrows.
Figure 5:
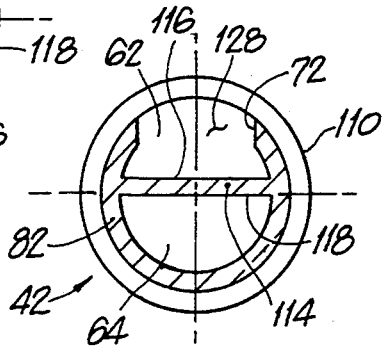
FIG. 5 is a cross-sectional view taken generally on the plane of line 5—5 of FIG. 2 and looking in the direction of the arrows.
Figure 6:
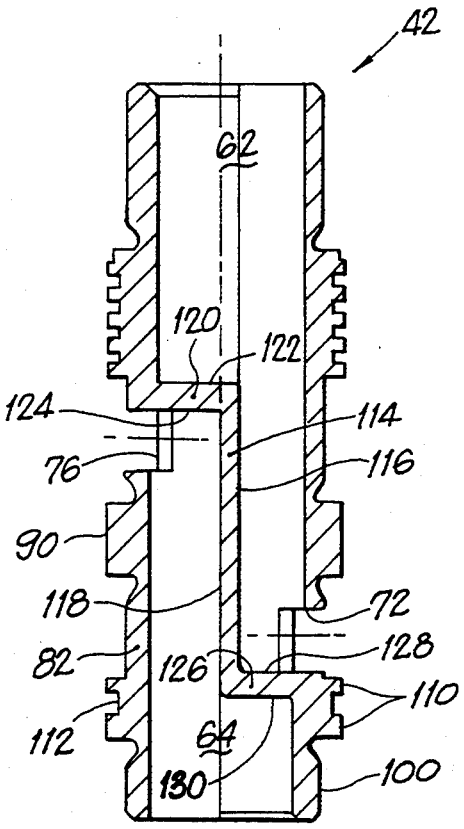
FIG. 6 is a generally axial cross-sectional view taken generally on the plane of line 6—6 of FIG. 3 and looking in the direction of the arrows.

Referring to FIGS. 3 and 6, the valve member 42 is shown having a generally medial axially extending wall 114, having its surface 116 defining a portion of passage or bore 62 and having its surface 118 defining a portion of passage or bore 64. A generally transverse wall portion 120 extends from the outer cylindrical wall 82 of member 42 to join the axially extending wall 114. Surface 122 of wall 120 defines a portion of passage or bore 62 while surface 124 defines a portion of passage or bore 64. A second generally transverse wall portion 126 extends from the outer cylindrical wall 82 of member 42 to join the axially extending wall 114. Surface 128 of wall 126 defines a portion of passage or bore 62 while surface 130 of wall 126 defines a portion of passage or bore 64.

Upon energization of solenoid coil or winding 28, the magnetic flux across the air gap between pole piece end surface 50 and armature end surface 60 will cause sleeve valve 56 to move upwardly against the biasing action of spring 58 until the upper end 60 of valve sleeve 56 engages the lower end 50 of pole piece 30. When armature sleeve 56 has moved upwardly into engagement with pole piece 30, annular groove 86 of valve sleeve 56 has moved upwardly a sufficient distance so that the upper end of groove 86 in the sleeve 56 now overlaps the annular groove or chamber 78 in fixed valve member 42 and the lower end of groove 86 in the valve sleeve 56 has moved upwardly beyond the upper end of annular groove or chamber 74. This movement of valve sleeve 56 terminates communication between groove 86 and annular chamber 74, but, groove 86 moves to where it is in communication with annular chamber 78 thereby placing such chamber 78 via groove 86 and aperture or passage 80 in communication with the control device 92 as via chamber 54 and conduit means 94. In this condition the high pressure fluid from source 70 is applied directly (via the passages described) to the control device 92.

External devices operatively connected to the assembly 10 are depicted schematically in FIG. 1. The electrical terminals 36 and 38 of solenoid coil 28 are electrically connected to a direct current power source indicated at DC which energizes coil 28 in cyclic pulses under the control of an electronic processor P. Processor P is supplied with appropriate inputs, depending upon the particular application, to vary the "on" time of the solenoid coil 28 during each cycle. In an automatic transmission control application, for example, inputs to the processor might include engine speed, vehicle speed, throttle position, etc. The pulsation frequency is a fixed frequency, often 60 Hz, and the processor will control the length or percentage of time during each cycle during which the solenoid coil 28 is energized.

Control port 54 of the valve assembly is hydraulically connected to the control device 92 which may be, for example, a pressure actuated clutch in an automatic transmission application. Passage 68 of the valve assembly 10 is shown connected to a supply of fluid under pressure 70 and conduit or port 66 is connected to a fluid sump S.

As hereinbefore described, when solenoid coil 28 is de-energized, valve sleeve 56 is in the position shown in FIG. 1 which establishes communication between the control device 92 and sump S.

When solenoid coil 28 is energized, valve sleeve 56 is axially shifted, as described above, to establish communication as between the control device 92 and the fluid pressure supply source 70.

With the solenoid coil 28 being energized in cyclic pulses of a time duration determined by the processor P and de-energized between successive pulses, the pressure supplied to the control device 92 will be a percentage of the pressure differential between the supply source 70 and sump S which is equal to the percentage of time solenoid coil 28 is energized. For example, if it is assumed that source 70 supplies fluid at 100 psi and the pressure existing at sump S is zero psi, if solenoid winding 28 is energized 50% of the time, the pressure supplied to the control device 92 will be 50 psi. If solenoid coil 28 is energized 70% of the time, the pressure supplied to the control device 92 will be at 70 psi.

Effectively, valve sleeve 56 is cyclically reciprocated between its two positions in accordance with the cyclic energization and de-energization of solenoid coil 28. When coil 28 is energized, the control device 92 is connected to fluid pressure source 70; and when the solenoid coil 28 is de-energized, the control device 92 is connected to fluid sump S or exhaust.

The embodiment shown in FIG. 1, as well as FIGS. 2–6, is well adapted to facilitate the required rapid shifting of the valve sleeve 56 between its two positions. With the exception of its biasing spring 58, valve sleeve 56 is the only moving part of the structure and its hollow, tubular configuration provides a relatively lightweight part. Valve sleeve 56 is constructed of steel or some other appropriate ferromagnetic material and functions as the armature of the solenoid without requiring additional moving parts. Only a relatively short stroke of valve sleeve 56 is required to shift the valve connections which enables the magnetic circuit to operate with a relatively small air gap. The sleeve is, at least for the most part, pressure balanced since both of its ends are within chamber 48, and the pressure within chamber 48 has no influence on movement of valve sleeve 56 between its operating positions. The forces exerted by spring 58 and solenoid coil 28 may, therefore, be relatively small forces while achieving the desired rapidity of movement of valve sleeve 56.

In the configuration shown in FIG. 1, lower portion 18 and intermediate portion 20 are of clyindrical configuration and conform to be mounted, in a plug-in fashion, into a manifold housing having internal passages appropriately located to match up with ports 54 and 68 of the assembly 10.

Figure 7:
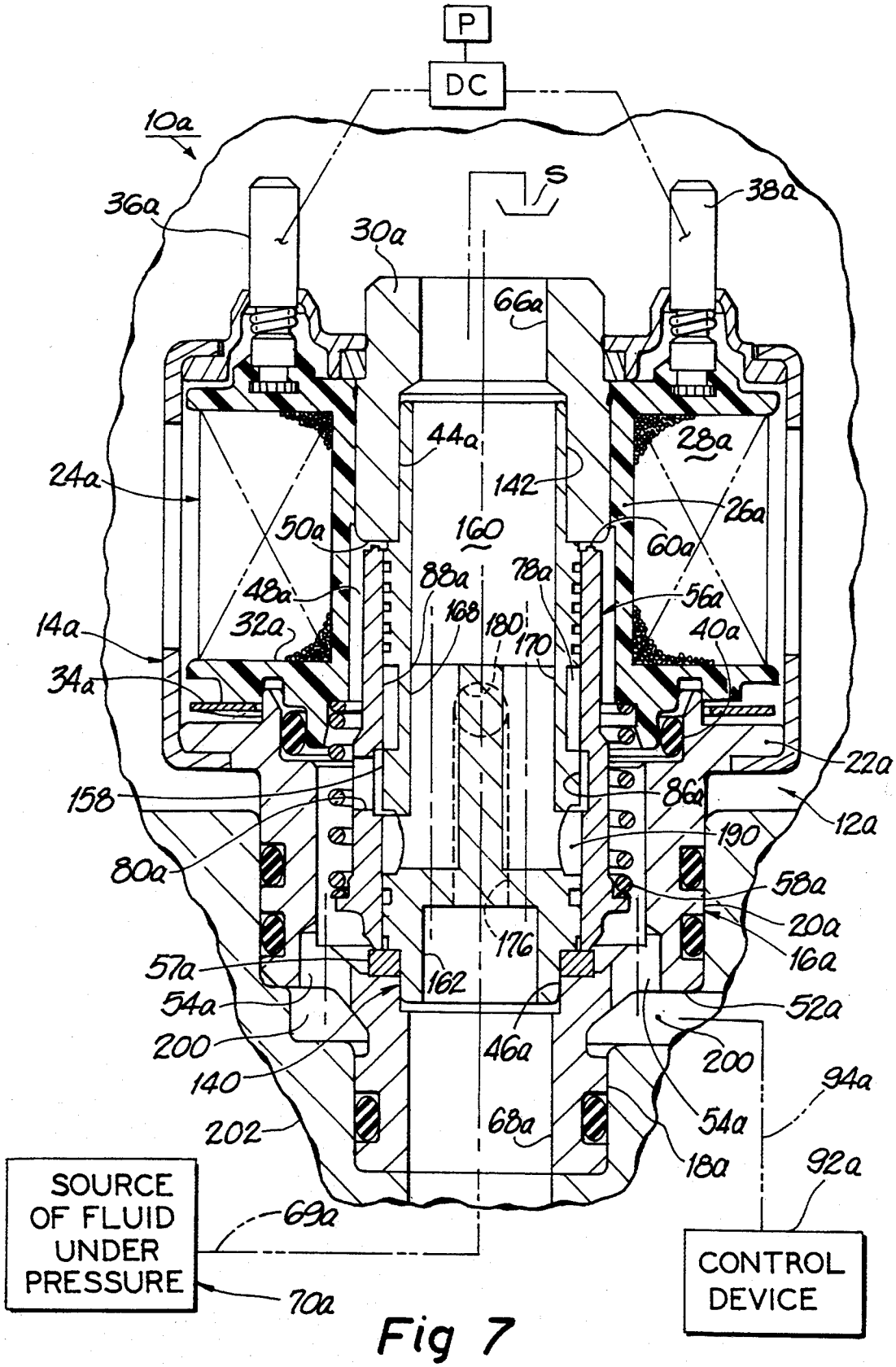
FIG. 7 is a generally axial cross-sectional view of a second pressure regulating device employing teachings of the invention.

FIG. 7, a view similar to that of FIG. 1, illustrates another solenoid operated valving assembly employing teachings of the invention. In FIG. 7 all elements and details which are like or similar to those of FIG. 1 are identified with like reference numbers provided with a suffix "a".

Instead of the fixed valve member 42 (FIGS. 1–6) the embodiment of FIG. 7 employs a fixed valve member 140 which is shown in greater detail in FIGS. 8–13.

Figure 8:
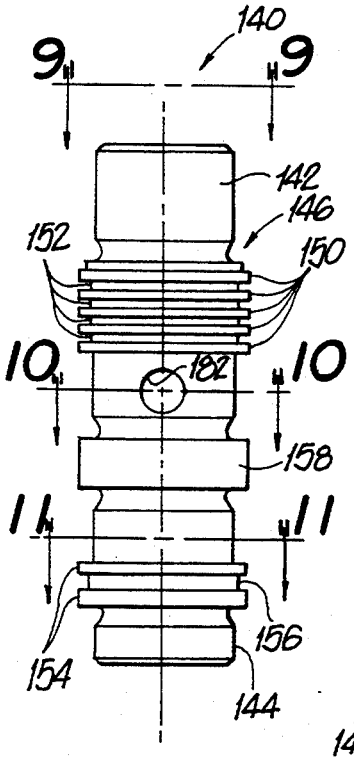
FIG. 8 is an elevational view, in somewhat reduced scale, of an element shown in FIG. 7.

As viewed in FIG. 8, the non-magnetic valve member 140, preferably comprised of stainless steel, has upper and lower cylindrical portions 142 and 144 (respectively received in bores **44*a* and 46*a* FIG. 7) and armature guiding or piloting portions 146 and 148. Annular surface or face 143 is in fluid sealing relationship with end face 50*a* of pole piece 30*a*. Pilot portion 146 is preferably comprised of a plurality of relatively narrow cylindrical surfaces 150—150 between which are respective annular grooves 152—152. Pilot portion 148 is similarly comprised of relatively narrow cylindrical surfaces 154—154 between which is an annular groove 156. A cylindrical land or valving surface 158 is carried by fixed valve body 140 so as to be generally juxtaposed to annular groove 86*a* of sleeve valve 56*a* (FIG. 7**).

Figure 12:
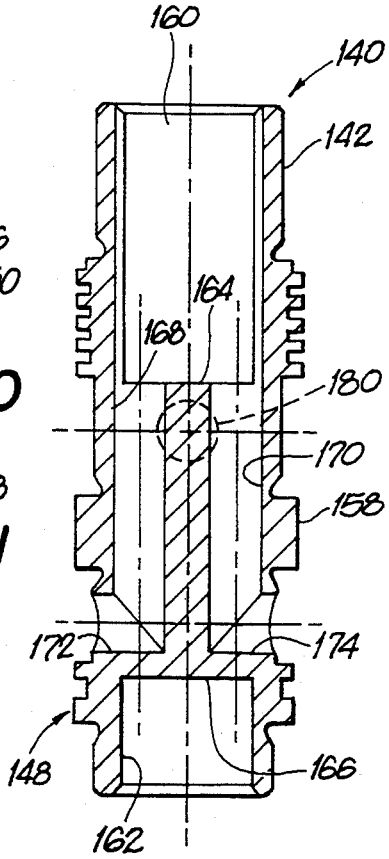
FIG. 12 is generally an axial cross-sectional view taken on the plane of line 12—12 of FIG. 9 and looking in the direction of the arrows.
Figure 13:
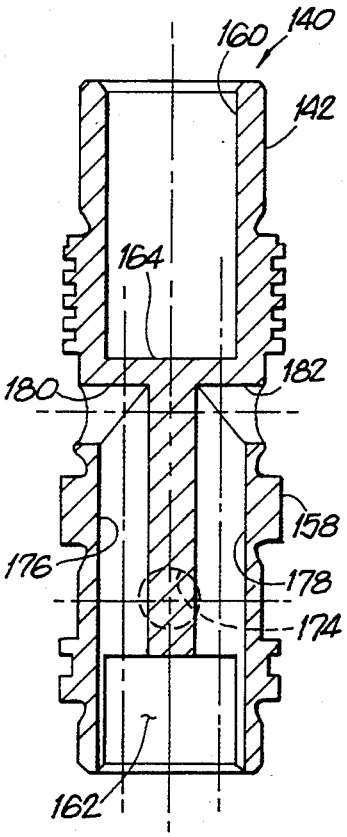
FIG. 13 is generally an axial cross-sectional view taken on the plane of line 13—13 of FIG. 9 and looking in the direction of the arrows.

FIGS. 12 and 13, as well as FIG. 7, show that a relatively large axially extending bore or passage 160 is formed in the upper portion (as viewed in FIGS. 12 and 13) of fixed cylindrical valve body 140, while a second axially extending bore or passage 162 is formed in the lower portion of valve body 140. The bores 160 and 162 may be considered as generally terminating at respective transverse end surfaces 164 and 166.

In the portion of valve body 140, generally between bores 160 and 162, a plurality of passages or conduits are formed with such conduits being provided with apertures or conduit portions which communicate with certain annular chambers or grooves as best seen in FIG. 7.

Figure 9:
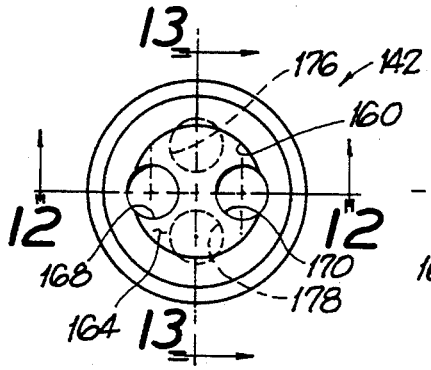
FIG. 9 is a view, in relatively enlarged scale, taken generally on the plane of line 9—9 of FIG. 8 and looking in the direction of the arrows.
Figure 10:
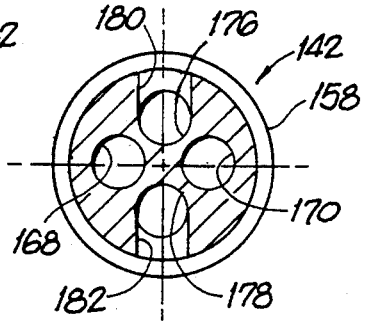
FIG. 10 is a relatively enlarged cross-sectional view taken generally on the plane of line 10—10 of FIG. 8 and looking in the direction of the arrows.
Figure 11:
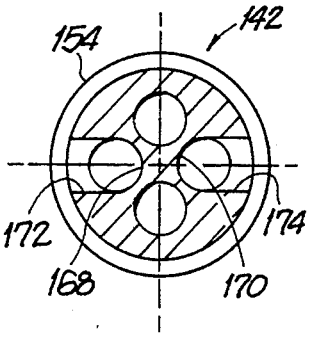
FIG. 11 is a relatively enlarged cross-sectional view taken generally on the plane of line 11—11 of FIG. 8 and looking in the direction of the arrows.

FIGS. 9 and 12 illustrate a first pair of passages or conduits 168 and 170 respectively extending through and from transverse surface 164 to transversely directed conduit portions 172 and 174 respectively. As is apparent, both conduits 168 and 170 are in free communication with bore 160.

Referring to FIGS. 9 and 13 a second set of conduits 176 and 178 are similarly formed in the portion of the valve body generally between bores 160 and 162. Conduits 176 and 178 respectively extend through and from transverse surface 166 to transversely directed conduit portions 180 and 182 respectively. Again, as should be apparent, conduits 176 and 178 are in free communication with bore 162.

Referring again to FIG. 7, when the solenoid coil or winding 28*a* is de-energized spring 58*a* will hold sleeve valve 56*a* in the depicted position wherein the juxtaposed ends 50*a* and 60*a* (of pole piece 30*a* and armature 56*a*, respectively) are spaced from each other by an air gap.

Conduits 168 and 170 serve to communicate the sump pressure from passage 66*a*, through bore 160 and through conduit segments 172, 174 (see FIG. 12) into an annular chamber 190 generally between fixed valve body 140 and valve sleeve 56*a*. Such an annular chamber 190 is just below the cylindrical valve land 158, as viewed in FIG. 7. At this time the cylindrical valve land 158 is, at its upper portion as viewed in FIG. 7, in overlapping relationship with the inner cylindrical surface 88*a* of armature 56*a*; therefore, no flow can occur from annular chamber 78*a* past valve land 158 into annular groove or recess 86*a* and through passage 80*a* and into and through the chambers and conduits leading to the control device 92*a*.

With the solenoid winding 28*a* de-energized, the source of fluid under pressure supplies pressurized fluid via conduit means 69*a*, bore 68*a*, bore 162, conduits 178 and 176 (also see FIG. 13) and conduit segments 182 and 180 to the annular chamber 78*a* which annularly exists between fixed valve body 140 and inner surface 88*a* of armature 56*a*. However, because the upper portion of valve land 158 is in overlapping relationships with armature 56*a* inner surface 88*a* all flow out of annular chamber 78*a* is prevented.

When the solenoid coil or winding 28*a* is energized, the magnetic flux across the air gap between pole piece end surface 50*a* and armature end surface 60*a* will cause sleeve valve 56*a* to move upwardly against the biasing action of spring 58*a* until the upper end 60*a* of valve sleeve 56*a* engages the lower end 50*a* of pole piece 30*a*. When armature sleeve 56*a* has moved upwardly into engagement with pole piece 30*a*, annular groove 86*a* of valve sleeve 56*a* has moved upwardly a sufficient distance so that the upper end of groove 86*a*, in the sleeve 56*a*, now overlaps the annular groove or chamber 78*a*, in fixed valve member 140, and the lower end of groove 86*a*, in the valve sleeve 56*a*, has moved upwardly beyond the upper end of annular groove or chamber 190. This described movement of valve sleeve 56*a* terminates communication between annular groove 86*a* and annular chamber 190 because of inner surface 88*a* of armature 56*a* now being in overlapping relationship to valve land 158 at the lower end thereof.

As a consequence the pressurized fluid from source 70*a* flows via conduit means 69*a*, bores 68*a*, 162 and through conduits 176, 178 (also see FIGS. 10, 11, 12, 13) and conduit sections 180, 182 into annular chamber 78*a* from where such pressurized fluid flows into the inner annular groove 86*a* and through passage or port 80*a* into chamber 48*a* and finally through passages 54*a*—54*a*, into chamber 200 and via conduit means 94*a* to the control device 92*a*.

As hereinbefore described, when solenoid coil 28*a* is de-energized, valve sleeve 56*a* is in the position shown in FIG. 7 which establishes communication between the control device 92*a* and sump S.

When solenoid coil 28 is energized, valve sleeve 56*a* is axially shifted, as previously described, to establish communication as between the control device 92*a* and the fluid pressure supply source 70.

As in the embodiment of FIG. 1, with the solenoid coil 28*a* being energized in cyclic pulses of a time duration determined by the processor P and de-energized between successive pulses, the pressure supplied to the control device 92*a* will be a percentage of the pressure differential between the supply source 70*a* and sump S which is equal to the percentage of time solenoid coil 28*a* is energized. For example, if it is assumed that source 70*a* supplies fluid at 100 psi and the pressure existing at sump S is zero psi, and if solenoid winding 28*a* is energized 50% of the time, the pressure supplied to the control device 92*a* will be 50 psi. If solenoid coil 28*a* is energized 70% of the time, the pressure supplied to the control device 92*a* will be at 70 psi.

Effectively, valve sleeve 56*a* is cyclically reciprocated between its two positions in accordance with the cyclic energization and de-energization of solenoid coil 28*a*. When coil 28*a* is energized, the control device 92*a* is connected to fluid pressure source 70; and when the solenoid coil 28*a* is de-energized, the control device 92*a* is connected to fluid sump S or exhaust.

The embodiment shown in FIG. 7, as well as FIGS. 8–13, is well adapted to facilitate the required rapid shifting of the valve sleeve 56*a* between its two positions. With the exception of its biasing spring 58*a*, valve sleeve 56*a* is the only moving part of the structure and its hollow, tubular configuration provides a relatively lightweight part. Valve sleeve 56*a* is constructed of steel or some other appropriate ferromagnetic material and functions as the armature of the solenoid without requiring additional moving parts. Only a relatively short stroke of valve sleeve 56*a* is required to shift the valve connections which enables the magnetic circuit to operate with a relatively small air gap. The sleeve is, at least for the most part, pressure balanced since both of its ends are within chamber 48*a*, and the pressure within chamber 48*a* has no influence on movement of valve sleeve 56*a* between its operating positions. The forces exerted by spring 58*a* and solenoid coil 28*a* may, therefore, be relatively small forces while achieving the desired rapidity of movement of valve sleeve 56*a*.

In the configuration shown in FIG. 7, lower portion 18*a* and intermediate portion 20*a* are of cylindrical configuration and conform to be mounted, in a plug-in fashion, into a manifold housing 202 having internal passages appropriately located to match up with ports 54*a* and 68*a* of the assembly 10*a*.

Although only a preferred embodiment and only one other embodiment of the invention have been disclosed and described, it is apparent that other embodiments and modifications of the invention are possible within the scope of the appended claims.

What is claimed is:

1. A pressure control valve assembly, comprising a housing, an elongated longitudinally extending valve member carried within said housing in a manner as to be in a fixed relationship with said housing, first longitudinally extending conduit means formed in said elongated valve member, second longitudinally extending conduit means formed in said elongated valve member, said elongated longitudinally extending valve member comprising first and second end portions respectively carried by said elongated valve member, wherein said first end portion comprises an open first axial end, wherein said second end portion comprises an open second axial end, a first fluid flow port formed through a wall of said elongated valve member, a second fluid flow port formed through a wall of said elongated valve member, wherein said first fluid flow port is situated at an axial location along said elongated valve member as to be axially generally between said open second axial end and said second fluid flow port, wherein said first longitudinally extending conduit means provides communication between said open first axial end and said first fluid flow port, wherein said second longitudinally extending conduit means provides communication between said open second axial end and said second fluid flow port, a generally tubular valve sleeve of magnetic material slidably mounted upon said elongated valve member, pole piece means juxtaposed to an axial end of said tubular valve sleeve, field coil means generally surrounding at least a portion of said elongated valve member and at least a portion of said tubular valve sleeve, wherein upon energization of said field coil means a magnetic flux is created causing the tubular valve sleeve to axially move toward said pole piece means and simultaneously bringing about communication between said second fluid flow port and a control port, wherein said control port is effective for operative communication with an associated control device, wherein said open second axial end is effective for communication with a source of fluid under pressure, wherein when said tubular valve sleeve axially moves toward said pole piece means fluid under pressure flows from said source to said second longitudinally extending conduit means and through said second fluid flow port and through said control port to said associated control device, whereupon when said field coil means is in a de-energized state magnetic flux is not generated by said field coil and said tubular valve sleeve does not move toward said pole piece, when said field coil means is in a de-energized state said tubular valve sleeve is effective to terminate communication between said second fluid flow port and said control port and simultaneously bring about communication between said first fluid flow port and said control port.

2. A pressure control valve assembly according to claim 1 wherein said first and second longitudinally extending conduit means extend alongside each other for at least a major longitudinal portion of said second longitudinally extending conduit means.

3. A pressure control valve assembly according to claim 1 and further comprising an additional first fluid flow port, wherein said additional first fluid flow port is formed through said wall of said elongated valve member and situated at an axial location along said elongated valve member as to be axially generally between said open second axial end and said second fluid flow port, wherein said first longitudinally extending conduit means comprises a plurality of first parallel flow conduits, and wherein one of said plurality of first parallel flow conduits provides communication between said open first axial end and said additional first fluid flow port.

4. A pressure control valve assembly according to claim 1 and further comprising an additional second fluid flow port, wherein said additional second fluid flow port is formed through said wall of said elongated valve member, wherein said second longitudinally extending conduit means comprises a plurality of second parallel flow conduits, and wherein one of said plurality of second parallel flow conduits provides communication between said open second axial end and said additional second fluid flow port.

5. A pressure regulating assembly for regulating the pressure of a flowing fluid medium, comprising a housing, said housing comprising a first housing portion and a second housing portion, an electrical field coil carried by said first housing portion, a pole piece situated generally within said field coil, an axially elongated generally cylindrical valve member carried within said first and second housing portions and in a fixed relationship to said first and second housing portions, a first fluid flow port formed through a wall of said axially elongated generally cylindrical valve member, a first opening formed in said axially elongated generally cylindrical valve member for communicating with a region of sump pressure, a first conduit formed in said axially elongated generally cylindrical valve member for communicating between said first opening and said first fluid flow port, a second fluid flow port formed through said wall of said axially elongated generally cylindrical valve member, a second opening formed in said axially elongated generally cylindrical valve member for communicating with a source of relatively high fluid pressure, a second conduit formed in said axially elongated generally cylindrical valve member for communicating between said second opening and said second fluid flow port, a generally tubular valve sleeve of magnetic material slidably mounted on said elongated valve member, wherein said pole piece is juxtaposed to an axial end of said tubular valve sleeve, wherein said field coil surrounds at least a portion of said tubular valve sleeve, wherein upon energization of said field coil a magnetic flux is created causing the tubular valve sleeve to axially move toward said pole piece, a cylindrical valving portion carried by said axially elongated generally cylindrical valve member, wherein said tubular valve sleeve comprises an inner cylindrical surface, an annular groove formed in said inner cylindrical surface and positioned as to be generally juxtaposed to said cylindrical valving portion, a passage formed through a wall of said tubular valve sleeve and communicating with said annular groove, wherein said second, housing comprises a control port effective for operative communication with an associated control device, wherein said passage communicates with said control port, a first annular chamber formed generally between said axially elongated generally cylindrical valve member and said tubular valve sleeve, said first annular chamber existing at a first axial side of said cylindrical valving portion and communicating with said second fluid flow port, a second annular chamber formed generally between said axially elongated generally cylindrical valve member and said tubular valve sleeve, said second annular chamber existing at a second axial side of said cylindrical valving portion opposite to said first axial side, wherein said second annular chamber is in communication with said first fluid flow port, wherein when said field coil is in a de-energized state said tubular valve sleeve is in a position whereat said annular groove completes communication between said second annular chamber and said passage, and wherein when said field coil is energized said tubular valve sleeve is positioned whereat said annular groove completes communication between said first annular chamber and said passage.

* * * * *